US011913294B2

(12) United States Patent
Day

(10) Patent No.: US 11,913,294 B2
(45) Date of Patent: Feb. 27, 2024

(54) COILED TUBING INJECTOR AND METHOD OF CONTROLLING SAME

(71) Applicant: Cenovus Energy Inc., Calgary (CA)

(72) Inventor: Mark Alexander Day, Calgary (CA)

(73) Assignee: Cenovus Energy Inc., Calgary (CA)

( * ) Notice: Subject to any disclaimer, the term of this patent is extended or adjusted under 35 U.S.C. 154(b) by 169 days.

(21) Appl. No.: 17/550,258

(22) Filed: Dec. 14, 2021

(65) Prior Publication Data

US 2022/0235617 A1 Jul. 28, 2022

Related U.S. Application Data

(60) Provisional application No. 63/142,922, filed on Jan. 28, 2021.

(51) Int. Cl.
*E21B 19/22* (2006.01)

(52) U.S. Cl.
CPC ..... *E21B 19/22* (2013.01)

(58) Field of Classification Search
CPC ..... E21B 19/22; E21B 19/20
See application file for complete search history.

(56) References Cited

U.S. PATENT DOCUMENTS 4,344,485 A 8/1982 Butler
5,092,402 A 3/1992 Perricone et al.
5,975,203 A 11/1999 Payne et al.
2009/0272520 A1* 11/2009 Hug ..... E21B 19/22 166/384
2018/0363391 A1* 12/2018 Dell ..... E21B 17/206
2019/0346340 A1* 11/2019 Martin ..... E21B 33/06

FOREIGN PATENT DOCUMENTS

CA 1304287 C 6/1992

* cited by examiner

*Primary Examiner* — Giovanna Wright
(74) *Attorney, Agent, or Firm* — Gordon & Jacobson, P.C.

(57) ABSTRACT

A coiled tubing injector for running coiled tubing into and out of a well in a hydrocarbon-bearing formation, includes a coiled tubing injector head including a base and a gripping mechanism configured to grip the coiled tubing running through the base and to advance and retract the coiled tubing, and a control system. The control system includes a coiled tubing indicator disposed between the gripping mechanism and a blowout preventer coupled to a head of the well, to indicate a change from presence of the coiled tubing to absence of the coiled tubing. The control system also includes a gripping mechanism control coupled to the coiled tubing indicator and operable to stop movement of gripping mechanism, thus discontinuing movement of the coiled tubing in response to the coiled tubing indicator indicating the change from the presence of the coiled tubing to the absence of the coiled tubing.

15 Claims, 4 Drawing Sheets

COILED TUBING INJECTOR AND METHOD OF CONTROLLING SAME

TECHNICAL FIELD

The present disclosure relates to the control of coiled tubing injectors for running coiled tubing into and out of a well in a hydrocarbon recovery operation.

BACKGROUND

Injection and production wells are commonly utilized in the recovery hydrocarbons from a hydrocarbon-bearing reservoir.

One method of recovering viscous hydrocarbons from a subterranean hydrocarbon-bearing formation using spaced horizontal wells is known as steam-assisted gravity drainage (SAGD). Various embodiments of the SAGD process are described in Canadian Patent No. 1,304,287 and corresponding U.S. Pat. No. 4,344,485. In the SAGD process, steam is injected through an upper, horizontal, injection well into a viscous hydrocarbon reservoir while hydrocarbons are produced from a lower, substantially parallel, horizontal, production well that is vertically spaced from and near the injection well. The injection and production wells are generally located close to the base of the hydrocarbon deposit to collect the hydrocarbons that flow toward the production well.

Coiled tubing is commonly run into and out of such wells utilizing a coiled tubing injector. For example, during a start-up phase of operation in SAGD, steam is generally injected through tubing strings extending through an injection well and a production well. Fluids are produced from both wells via the annulus of each well, around the respective tubing string. The steam is thus circulated to heat the viscous hydrocarbons, promoting flow of the hydrocarbons to develop fluid communication between the injection well and the production well. After sufficient heating of the hydrocarbons around the injection well and the production well, the start-up phase is discontinued. One or more tubing strings may be retracted from the well after start-up, for example, to reconfigure the well for production.

The removal of the coiled tubing from a well may present safety issues as the end of the coiled tubing exits the well and moves past the coiled tubing injector, leaving the free end uncontained. In such a case, the movement of the coiled tubing may be uncontrolled and the release of pressure unpredictable.

Improvements in retraction of coiled tubing from a well in a hydrocarbon bearing formation are desirable.

SUMMARY

According to an aspect of an embodiment, there is provided a coiled tubing injector for running coiled tubing into and out of a well in a hydrocarbon-bearing formation, includes a coiled tubing injector head including a base and a gripping mechanism configured to grip the coiled tubing running through the base and to advance and retract the coiled tubing, and a control system. The control system includes a coiled tubing indicator disposed between the gripping mechanism and a blowout preventer coupled to a head of the well, to indicate a change from presence of the coiled tubing to absence of the coiled tubing. The control system also includes a gripping mechanism control coupled to the coiled tubing indicator and operable to stop movement of gripping mechanism, thus discontinuing movement of the coiled tubing in response to the coiled tubing indicator indicating the change from the presence of the coiled tubing to the absence of the coiled tubing.

According to another aspect of an embodiment, there is provided a method of controlling a coiled tubing injector for running coiled tubing into and out of a well in a hydrocarbon-bearing formation. The method includes retracting the coiled tubing from the well utilizing a gripping mechanism of the coiled tubing injector, and, in response to an indication of a change from presence of coiled tubing to absence of coiled tubing at a coiled tubing indicator disposed between the gripping mechanism and a blowout preventer coupled to a head of the well, automatically discontinuing retracting the coiled tubing.

BRIEF DESCRIPTION OF THE DRAWINGS

Embodiments of the present invention will be described, by way of example, with reference to the drawings and to the following description, in which.

DETAILED DESCRIPTION

Figure 1:
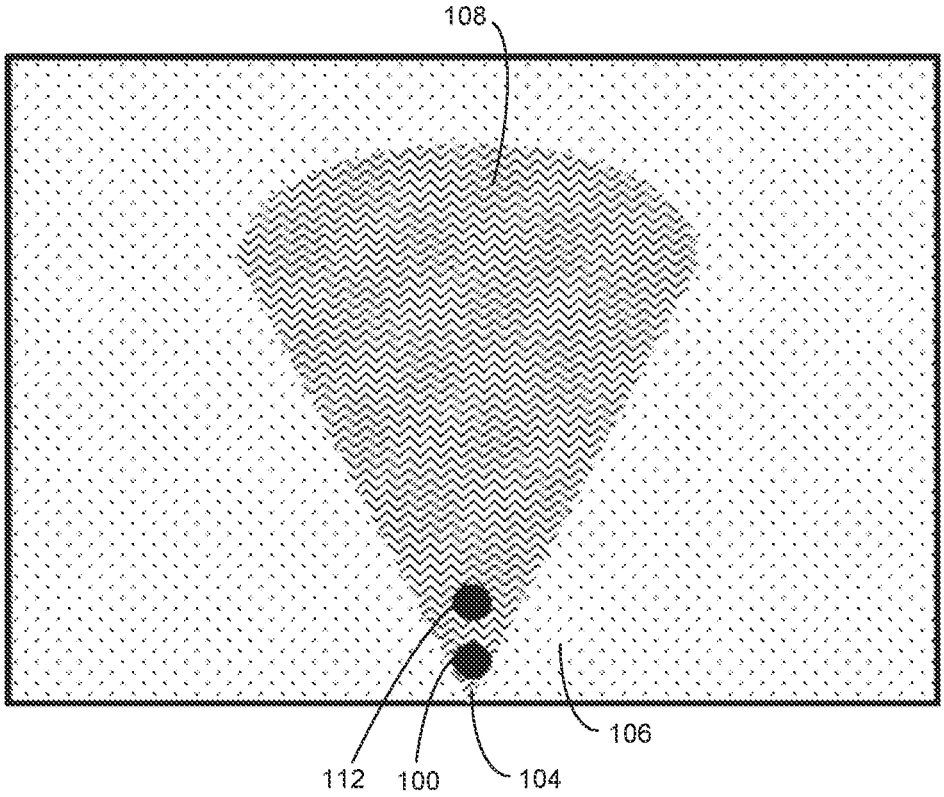
FIG. 1 is a schematic sectional view of a reservoir and shows the relative location of an injection well and a production well.

The disclosure generally relates to a coiled tubing injector for running coiled tubing into and out of a well in a hydrocarbon-bearing formation, includes a coiled tubing injector head including a base and a gripping mechanism configured to grip the coiled tubing running through the base and to advance and retract the coiled tubing, and a control system. The control system includes a coiled tubing indicator disposed between the gripping mechanism and a blowout preventer coupled to a head of the well, to indicate a change from presence of the coiled tubing to absence of the coiled tubing. The control system also includes a gripping mechanism control coupled to the coiled tubing indicator and operable to stop movement of gripping mechanism, thus discontinuing movement of the coiled tubing in response to the coiled tubing indicator indicating the change from the presence of the coiled tubing to the absence of the coiled tubing.

For simplicity and clarity of illustration, reference numerals may be repeated among the figures to indicate corresponding or analogous elements. Numerous details are set forth to provide an understanding of the examples described herein. The examples may be practiced without these details. In other instances, well-known methods, procedures, and components are not described in detail to avoid obscuring the examples described. The description is not to be considered as limited to the scope of the examples described herein.

Reference is made herein to an injection well and a production well. The injection well and the production well may be physically separate wells. Alternatively, the production well and the injection well may be housed, at least partially, in a single physical wellbore, for example, a multilateral well. The production well and the injection well may be functionally independent components that are hydraulically isolated from each other, and housed within a single physical wellbore.

The description below refers generally to wells utilized in SAGD. The coiled tubing injector and the method described herein are not limited to SAGD, however, as the coiled tubing injector and the method may be utilized in other operations in which a well is utilized.

Figure 2:
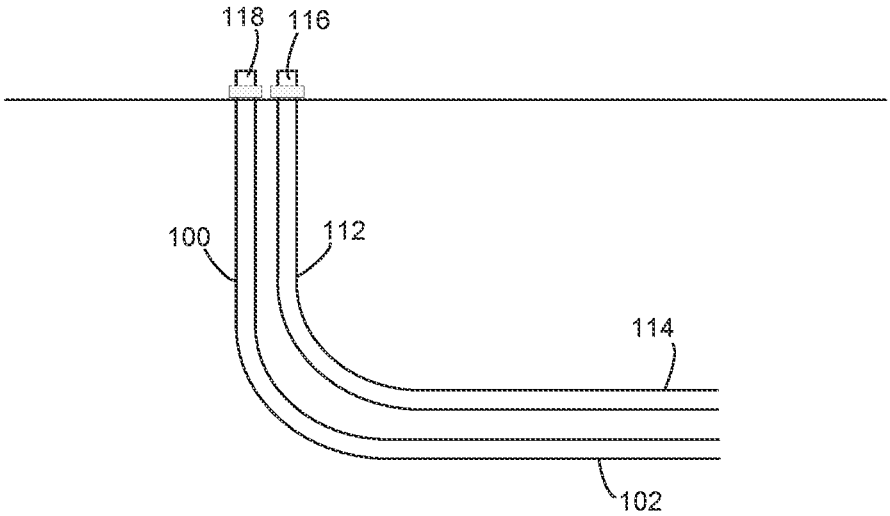
FIG. 2 is a sectional side view of a well pair including an injection well and a production well.

In one example, a steam-assisted gravity drainage (SAGD) process may be utilized for mobilizing viscous hydrocarbons. In the SAGD process, a well pair, including a hydrocarbon production well and a steam injection well are utilized. An example of a well pair is illustrated in FIG. 1 and FIG. 2. The hydrocarbon production well 100 includes a generally horizontal portion 102 that extends near the base or bottom 104 of the hydrocarbon reservoir 106. An injection well 112 also includes a generally horizontal portion 114 that is disposed generally parallel to and is spaced vertically above the horizontal portion 102 of the hydrocarbon production well 100.

During a production phase of SAGD, steam is injected through the injection well head 116 and through the steam injection well 112 to mobilize the hydrocarbons and create a steam chamber 108 in the reservoir 106, around and above the generally horizontal portion 114.

Viscous hydrocarbons in the reservoir 106 are heated and mobilized and the mobilized hydrocarbons drain under the effects of gravity. Fluids, including the mobilized hydrocarbons along with condensate, are collected in the generally horizontal portion 102 and are recovered via the hydrocarbon production well 100. Production may be carried out for any suitable period of time.

As indicated above, the description generally refers to SAGD herein. The coiled tubing injector and the method described herein are not limited to SAGD, however. Coiled tubing (CT) has many applications and has been widely applied in the petroleum industry, including, for example, in drilling (CT drilling), cementing, wellbore cleanout, acidizing, sand control, testing, logging, workovers, and hydraulic fracturing. Thus, the injector and the method described herein are also applicable to other operations. SAGD is referred to for the purpose of providing one particular example of the use of the injector and method of controlling the coiled tubing injector.

A coiled tubing injector may be utilized to run coiled tubing into and out of a well, for example, for use in running instruments, shift tools, or other equipment downhole or for pump stimulation or other fluids. A coiled tubing injector may be utilized during workover of the injection well 112 or the production well 100. In a particular example, a workover is performed between a start-up phase of a SAGD operation and a production phase of the SAGD operation.

During the start-up phase of operation in SAGD, steam is generally injected through tubing strings that extend through the injection well 112 and through the production well 100, respectively. Fluids are produced from both wells via the annulus of each well, around the respective tubing string. The fluids that are produced are primarily steam, although some small amount of hydrocarbons may be present. The steam is thus circulated to heat the viscous hydrocarbons, promoting flow of the hydrocarbons to develop fluid communication between the injection well 112 and the production well 100.

After sufficient heating of the hydrocarbons around the injection well 112 and the production well 100, the start-up phase is discontinued. A workover is performed to reconfigure the wells for the production phase of the operation, in particular, for injection of steam via the injection well and production of fluids via the production well. The workover is performed to change, add, or remove equipment and may include retraction of coiled tubing in one or both of the injection well 112 and the production well 100.

Before the production phase, the coiled tubing string extending through the production well 100, for example, is utilized to run monitoring instruments into the well. The coiled tubing string that is utilized to run monitoring instruments or for other equipment, may later be removed.

Removal of the coiled tubing, however, presents risks, particularly in the event that the coiled tubing exits the injector, resulting in uncontrolled "whipping" of the coiled tubing. The coiled tubing that comes out of the injector poses a physical hazard as the uncontrolled movement may cause the coiled tubing to hit and injure nearby workers.

In addition, the pressure in the reservoir 106 and into the production well 100 may be in the range of, for example, about 2500 kPa to about 3200 kPa. In addition, to steam, hydrogen sulfide as well as vapours from lighter hydrocarbons may enter the well, exiting at the wellhead and posing a danger while work is performed on the well. These vapours pose a risk to workers near the production well head 118 when the well head is open. With an increase in the use of solvents in hydrocarbon recovery processes, these vapors are more likely to enter the wellbore, escape to the atmosphere, and pose risk to workers.

Figure 3A:
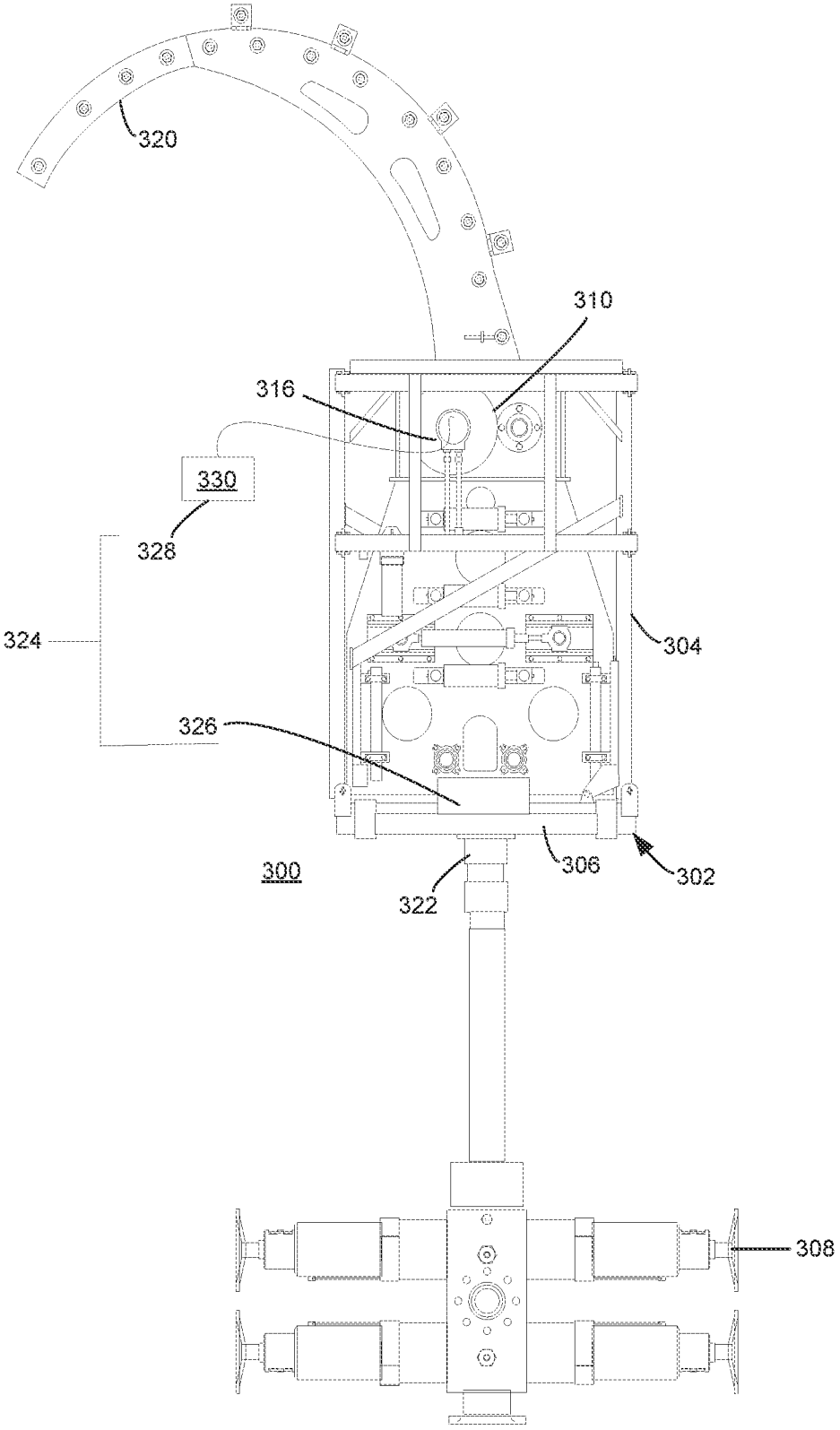
FIG. 3A is a side view of a coiled tubing injector according to an embodiment.
Figure 3B:
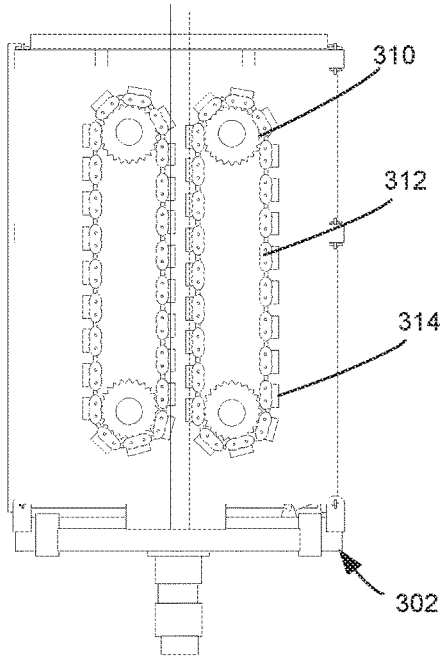
FIG. 3B is a side view of the coiled tubing injector of FIG. 3A, with parts removed to show internal components thereof.

Referring to FIG. 3A and FIG. 3B, a coiled tubing injector 300 according to one embodiment is illustrated. The coiled tubing injector 300 includes a coiled tubing injector head 302 that includes a frame 304. The frame 304 is mounted above a wellhead, such as the production well head 118 or the injection well head 116 to support and to inject the coiled tubing into the well or to retract coiled tubing from the well. The frame 304 includes a base 306 that is supported above blowout preventers 308 in a stack on the wellhead. The frame 304 also includes frame members 310 that are connected to the base 306 and that, together provide the frame in which components of the coiled tubing injector head 302 are housed or mounted.

The coiled tubing injector head 302 includes a gripping mechanism 310 that includes a pair of opposing endless chains 312 with links of the chains 312 coupled to gripper blocks 314 that act on opposing sides of the coiled tubing by applying force on diametrically opposite sides of the coiled tubing. The gripping mechanism 310 also includes hydraulic motors 316. Each of the hydraulic motors 316 is coupled to a respective one of the endless chains 312 to drive the chains 312 forward or backward, thus injecting or retracting the coiled tubing.

The coiled tubing injector head 302 may include other elements, for example, to adjust the spacing between the gripper blocks 314 and thus adjust the force applied to the coiled tubing.

The coiled tubing injector 300 also includes a goose neck 320 coupled to the coiled tubing injector head 302. The goose neck 320 directs the coiled tubing from a coiled tubing reel, into the coiled tubing injector head 302. The coiled tubing is then directed through the gripping mechanism 310 and downwardly to the well.

The coiled tubing injector 300 also includes a control system 324 utilized to control the hydraulic motors 316. The control system 324 includes a coiled tubing indicator 326 disposed between the gripping mechanism 310 and the blowout preventers 308. The control system 324 is utilized to indicate a change from presence of the coiled tubing to absence of the coiled tubing. In the present example, the coiled tubing indicator 326 is disposed between the gripping mechanism 310 and a coiled tubing stripper 322, near the base 306.

The control system also includes a gripping mechanism control 328 that is connected to the coiled tubing indicator 326 and to the hydraulic motors 316 to control the hydraulic motors 316 to stop movement of gripping mechanism 310, thus discontinuing movement of the coiled tubing in response to the coiled tubing indicator 326 indicating the change from the presence of the coiled tubing to the absence of the coiled tubing.

Figure 4:
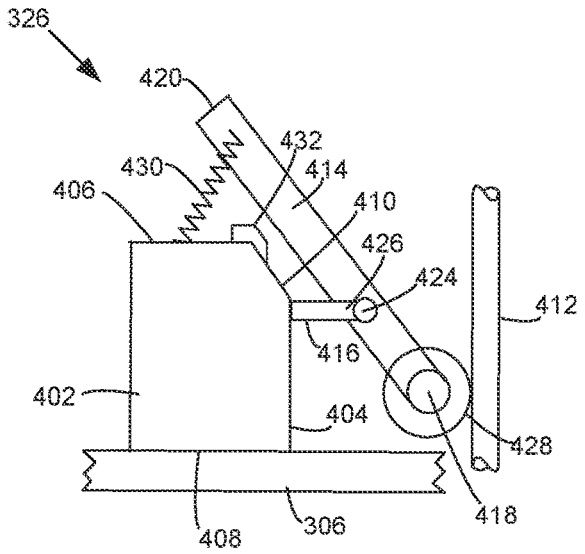
FIG. 4 is an enlarged portion of the coiled tubing injector of FIG. 3A, showing an indicator arm in a first position.

Reference is made to FIG. 4 to describe the coiled tubing indicator 326 according to one embodiment. As illustrated in FIG. 4, the coiled tubing indicator 326 includes a support structure 402 that is mounted on the base 306 of the frame 304. The support structure 402 may be a frame or may be a solid structure mounted on the base 306, below the gripping mechanism 310. In the present example, the support structure 402 is a solid structure including sides 404, a top 406, and a bottom 408 that is fixed to the base 306. The support structure 402 in this example includes a chamfered edge 410 between the top 406 and the one of the sides 404 that is closest to the coiled tubing 412.

An indicator arm 414 is coupled to the support structure 402 by a yoke mount 416. The indicator arm 414 is a rectangular member that includes a first end 418 and an opposing second end 420.

One end of the yoke mount 416 is fixed to the one of the sides 404 of the support structure 402 that is closest to the coiled tubing 412. The yoke mount 416 extends away from the support structure 402 and couples to the indicator arm 414 by a hinge pin 424 that extends through the indicator arm 414 and couples to arms 426 of the yoke mount 416. The indicator arm 414 is moveable relative to the arms 426 of the yoke mount 416 by rotation about the hinge pin 414.

A roller 428 is rotatably coupled to the indicator arm 414, near the first end 418 of the indicator arm 414. The roller 428 is rotatable relative to the indicator arm 414. The roller 428 is biased away from the support structure 402 and into contact with the coiled tubing 412 by a biasing mechanism 430 that acts on the indicator arm 414. The biasing mechanism 430 in the present example comprises a spring coupled at one end to the support structure 402 and coupled at the opposing end to the indicator arm 414. Thus, in this example, the biasing mechanism acts on the indicator arm 414, on an opposite side of the yoke mount, to bias the second end 420 toward the support structure 402 and thus bias the roller 428 toward the coiled tubing 412.

A switch 432 is mounted on the support structure 402, on or near the chamfered edge 410. The switch 432 is located such that the switch 432 is actuatable by the indicator arm 414 when the coiled tubing 412 is absent and therefore not acting against the roller 428. Thus, when the coiled tubing 412 is absent, the indicator arm 414 moves, as a result of the bias from the biasing mechanism 430, from the position show in FIG. 4 in which the roller 428 abuts the coiled tubing 412, to the position shown in FIG. 5 in which the indicator arm 414 actuates the switch 432.

Figure 5:
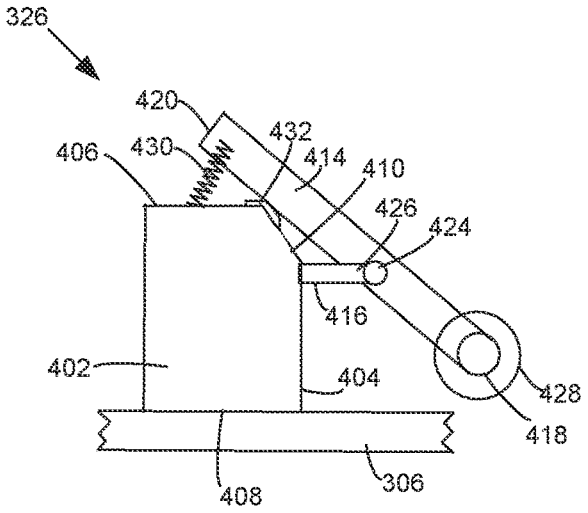
FIG. 5 is the enlarged portion of the coiled tubing injector of FIG. 4 with the indicator arm in a second position.

Referring again to FIG. 3A and FIG. 3B, in addition to FIG. 4 and FIG. 5, the switch 432 is connected to a controller 330 that together are part of the gripping mechanism control 328. The controller 330 is connected to the hydraulic motors 316. The switch 432 may be connected by wired connection to the controller 330 or by a wireless connection, to communicate with the controller 330 when the switch 432 is actuated. The controller 330 causes the hydraulic motors of the gripping mechanism to discontinue movement of the coiled tubing when the switch 432 is actuated. Thus, in response to the coiled tubing indicator 326 indicating the change from the presence of the coiled tubing to the absence of the coiled tubing, the gripping mechanism controller 328 discontinues movement of the coiled tubing to inhibit the coiled tubing from exiting the gripping mechanism 310.

The controller 330 may also include a control panel or device connected thereto and that is controllable by an operator to control the operation of the hydraulic motors 316 and the gripping mechanism 310.

Figure 6:
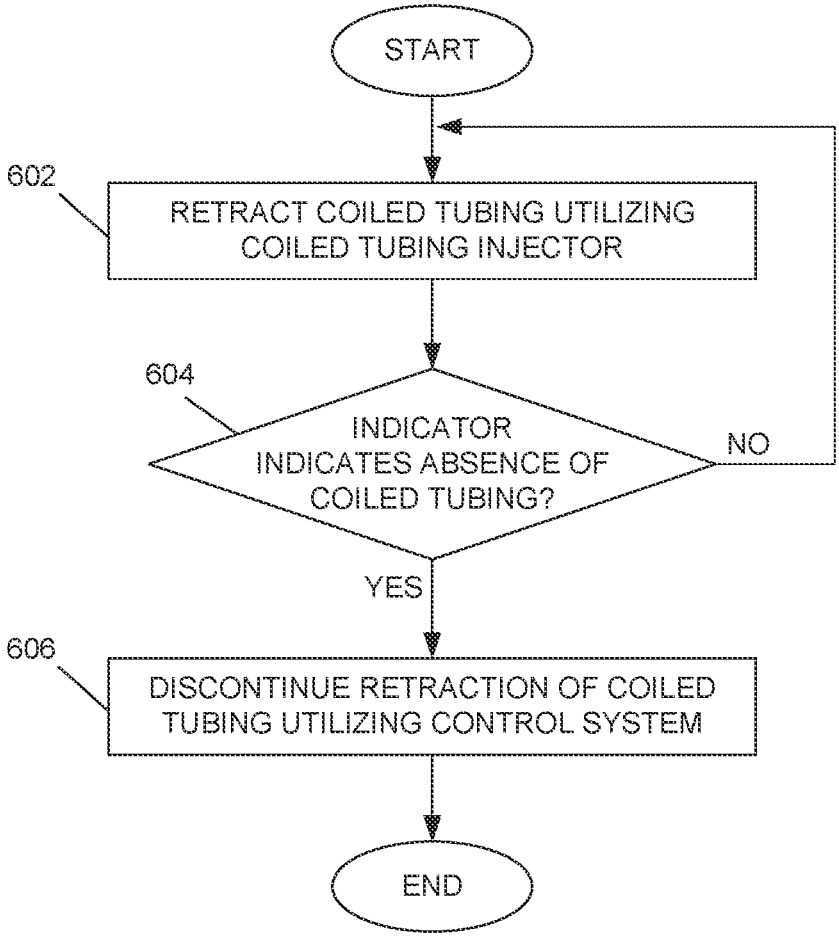
FIG. 6 is a flowchart showing a method of controlling a coiled tubing injector for running coiled tubing according to an embodiment.

Reference is now made to FIG. 6 to describe a method of controlling a coiled tubing injector for running coiled tubing into and out of a well in a hydrocarbon-bearing formation. The method may contain additional subprocesses other than that shown or described.

The coiled tubing injector 300 is utilized to retract coiled tubing in the well at 600. The coiled tubing injector 300 is controlled by controlling the hydraulic motors 316 to retract the coiled tubing.

In response to the indicator indicating that the coiled tubing is present at the coiled tubing indicator 326 at 604, the method continues at 602 and retraction of the coiled tubing continues. In response to the indicator indicating that the coiled tubing is absent at the coiled tubing indicator 326 at 604, the method continues at 606 and retraction of the coiled tubing is discontinued. The indicator indicates that the coiled tubing is absent as the indicator arm 414 moves to the second position shown in FIG. 5. The switch 432 is actuated by the indicator arm 414 and sends a signal to the controller 330 as the indicator arm 414 moves to the second position. In turn, the controller 330 stops the hydraulic motors 316, thus stopping the gripping mechanism and stopping retraction of the coiled tubing.

In the above-described embodiment, the coiled tubing indicator 326 is coupled to the base 306, above the coiled tubing stripper 322 and below the gripping mechanism 310. Alternatively, the coiled tubing indicator 326 may be disposed below the coiled tubing stripper, and above the blowout preventers 308, such that the coiled tubing indicator 326 is located within a pressure contained region above the wellhead. By including a coiled tubing indicator 326 in the pressure contained region, the coiled tubing indicator 326 is positioned to indicate the change from the presence of the coiled tubing to the absence of coiled tubing prior to withdrawal of the coiled tubing from the pressure containment.

In addition, in the above-described embodiment, the coiled tubing indicator is a mechanical indicator. The mechanical indicator may take other forms than that specifically described. In addition, other devices or indicators may be utilized to sense the end of the coiled tubing.

Advantageously, the control system is utilized to automatically detect the end of the coiled tubing by detecting that there is no longer coiled tubing at the coiled tubing indicator, and to stop the hydraulic motors, thereby stopping retraction of the coiled tubing. By automating the detection and stopping of the retraction, there is less chance of the coiled tubing becoming completely removed from the gripping mechanism and resulting in uncontrolled release of the coiled tubing from the gripping mechanism. Thus, the end of the coiled tubing remains controlled. In addition, the continued control of the end of the tubing provides for improved safety for the operators.

The described embodiments are to be considered in all respects only as illustrative and not restrictive. The scope of the claims should not be limited by the preferred embodiments set forth in the examples, but should be given the broadest interpretation consistent with the description as a whole. All changes that come with meaning and range of equivalency of the claims are to be embraced within their scope.

The invention claimed is:

1. A coiled tubing injector for running coiled tubing into and out of a well in a hydrocarbon-bearing formation, the coiled tubing injector comprising:

a coiled tubing injector head including a base and a gripping mechanism configured to grip the coiled tubing running through the base and to advance and retract the coiled tubing;

a control system including a coiled tubing indicator disposed between the gripping mechanism and a blowout preventer coupled to a head of the well, to indicate a change from presence of the coiled tubing to absence of the coiled tubing, a gripping mechanism control coupled to the coiled tubing indicator and operable to stop movement of the gripping mechanism, thus discontinuing movement of the coiled tubing in response to the coiled tubing indicator indicating the change from the presence of the coiled tubing to the absence of the coiled tubing;

wherein the coiled tubing indicator comprises an indicator arm moveable between a first position in which the coiled tubing is present and a second position in which the coiled tubing is absent.

2. The coiled tubing injector according to claim 1, wherein the coiled tubing indicator is located near the base of the coiled tubing injector head, above a coiled tubing stripper.

3. The coiled tubing injector according to claim 1, wherein the coiled tubing indicator is located between a coiled tubing stripper and the blowout preventer.

4. The coiled tubing injector according to claim 1, wherein the coiled tubing indicator is located to indicate the change from presence of the coiled tubing to absence of the coiled tubing prior to withdrawal of the coiled tubing from pressure containment.

5. The coiled tubing injector according to claim 1, wherein the indicator arm is biased against the coiled tubing when the coiled tubing is present and moves to the second position by the force of the bias in the absence of the coiled tubing.

6. The coiled tubing injector according to claim 1, wherein the gripping mechanism control includes a switch actuatable by the indicator arm when the indicator arm moves to the second position.

7. The coiled tubing injector according to claim 6, wherein the switch is configured to control hydraulic motors of the gripping mechanism to discontinue movement of the coiled tubing in response to the coiled tubing indicator indicating the change from the presence of the coiled tubing to the absence of the coiled tubing.

8. The coiled tubing injector according to claim 1, wherein the gripping mechanism control controls hydraulic motors of the gripping mechanism to discontinue movement of the coiled tubing in response to the coiled tubing indicator indicating the change from the presence of the coiled tubing to the absence of the coiled tubing.

9. A method of controlling a coiled tubing injector for running coiled tubing into and out of a well in a hydrocarbon-bearing formation, the method comprising:

retracting the coiled tubing from the well utilizing a gripping mechanism of the coiled tubing injector;

in response to an indication of a change from presence of coiled tubing to absence of coiled tubing at a coiled tubing indicator disposed between the gripping mechanism and a blowout preventer coupled to a head of the well, automatically discontinuing retracting the coiled tubing;

wherein the coiled tubing indicator comprises an indicator arm coupled to a base of the coiled tubing injector, and the indication of a change comprises movement of the indicator arm from a first position in which the coiled tubing is present and a second position in which the coiled tubing is absent.

10. The method according to claim 9, wherein automatically discontinuing retracting the coiled tubing comprises controlling hydraulic motors of the gripping mechanism utilizing a gripping mechanism controller to discontinue movement of the coiled tubing in response to the indication from the coiled tubing indicator.

11. The method according to claim 9, wherein the coiled tubing indicator is coupled to a base of the coiled tubing injector and above a coiled tubing stripper, such that automatically discontinuing retracting the coiled tubing comprises discontinuing retracting prior to entry of an end of the coiled tubing into the gripping mechanism.

12. The method according to claim 9, wherein the coiled tubing indicator is located between a coiled tubing stripper and a blowout preventer such that automatically discontinuing retracting the coiled tubing comprises discontinuing retracting the coiled tubing prior to withdrawal of the coiled tubing from pressure containment.

13. The method according to claim 9, wherein automatically discontinuing retracting the coiled tubing comprises discontinuing retracting the coiled tubing in response to receipt of a signal from a switch actuated by the movement of the indicator arm to the second position.

14. The method according to claim 13, wherein automatically discontinuing retracting the coiled tubing comprises controlling hydraulic motors of the gripping mechanism to discontinue movement of the coiled tubing.

15. The method according to claim 14, wherein controlling hydraulic motors comprises discontinuing retracting the coiled tubing in response to receipt of the signal from the switch.

* * * * *